US012070080B2

(12) United States Patent
Kim et al.

(10) Patent No.: US 12,070,080 B2
(45) Date of Patent: Aug. 27, 2024

(54) AEROSOL GENERATING SYSTEM

(71) Applicant: KT&G CORPORATION, Daejeon (KR)

(72) Inventors: Young Joong Kim, Daejeon (KR); Sun Hwan Jung, Daejeon (KR); Sung Jong Ki, Daejeon (KR); In Su Park, Seoul (KR); John Tae Lee, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 527 days.

(21) Appl. No.: 17/413,609

(22) PCT Filed: Mar. 4, 2021

(86) PCT No.: PCT/KR2021/002697
§ 371 (c)(1),
(2) Date: Jun. 14, 2021

(87) PCT Pub. No.: WO2021/230477
PCT Pub. Date: Nov. 18, 2021

(65) Prior Publication Data

US 2022/0110373 A1 Apr. 14, 2022

(30) Foreign Application Priority Data

May 14, 2020 (KR) ..... 10-2020-0057824

(51) Int. Cl.
*A24F 40/57* (2020.01)
*A24D 1/20* (2020.01)
(Continued)

(52) U.S. Cl.
CPC ..... *A24F 40/57* (2020.01); *A24D 1/20* (2020.01); *A24F 40/20* (2020.01); *A24F 40/60* (2020.01)

(58) Field of Classification Search
CPC ..... A24F 40/57; A24F 40/20; A24F 40/60; A24F 1/20; A24D 1/20
(Continued)

(56) References Cited

U.S. PATENT DOCUMENTS

| | | | | |
|---|---|---|---|---|
| 10,588,340 | B2 | 3/2020 | Bell et al. | |
| 11,013,872 | B2 | 5/2021 | Silvestrini et al. | |
| 2007/0074734 | A1 | 4/2007 | Braunshteyn et al. | |
| 2017/0318858 | A1* | 11/2017 | Hodin | A24F 23/02 |

(Continued)

FOREIGN PATENT DOCUMENTS

| | | | |
|---|---|---|---|
| EP | 2110033 | A1 | 10/2009 |
| JP | 2016-527913 | A | 9/2016 |

(Continued)

OTHER PUBLICATIONS

Notification of Reasons for Refusal dated Sep. 13, 2022 from the Japanese Patent Office in application No. 2021-532131.

(Continued)

*Primary Examiner* — Gary F Paumen
(74) *Attorney, Agent, or Firm* — Sughrue Mion, PLLC

(57) ABSTRACT

An aerosol generating system includes an aerosol generating article and an aerosol generating device, wherein the aerosol generating article includes a tobacco medium portion and an aerosol generator, the tobacco medium portion including a tobacco material and a pH adjuster, and the aerosol generator including an aerosol generating material.

The aerosol generating device includes a heater configured to receive power from a battery to heat the aerosol generating material, and a controller configured to control power supply to the heater.

When the heater operates in a smokeless mode, an aerosol is not generated from the aerosol generating material, and when the heater operates in a smoke mode, an aerosol is generated from the aerosol generating material.

15 Claims, 9 Drawing Sheets

(51) Int. Cl.
*A24F 40/20* (2020.01)
*A24F 40/60* (2020.01)

(58) Field of Classification Search
USPC ..... 131/328
See application file for complete search history.

(56) References Cited

U.S. PATENT DOCUMENTS

| | | | | |
|---|---|---|---|---|
| 2018/0132526 | A1 | 5/2018 | Davis et al. | |
| 2018/0279666 | A1 | 10/2018 | Aoun et al. | |
| 2019/0046436 | A1 | 2/2019 | Hazani | |
| 2020/0093177 | A1 | 3/2020 | Han et al. | |
| 2020/0113227 | A1 | 4/2020 | McLaughlin et al. | |
| 2020/0128880 | A1 | 4/2020 | Gage et al. | |
| 2020/0154773 | A1 | 5/2020 | Lim et al. | |
| 2020/0359688 | A1 | 11/2020 | Jang et al. | |
| 2021/0046257 | A1 | 2/2021 | Tucker et al. | |
| 2021/0068464 | A1* | 3/2021 | Lauenstein | A24F 40/50 |
| 2021/0169148 | A1 | 6/2021 | Nakano et al. | |

FOREIGN PATENT DOCUMENTS

| | | | |
|---|---|---|---|
| JP | 2018-515119 | A | 6/2018 |
| JP | WO2020/039589 | A1 | 2/2020 |
| KR | 10-2010-0127817 | A | 12/2010 |
| KR | 10-1314895 | B1 | 10/2013 |
| KR | 1020150005514 | A | 1/2015 |
| KR | 10-2016-0098212 | A | 8/2016 |
| KR | 1020170111266 | A | 10/2017 |
| KR | 10-2018-0070509 | A | 6/2018 |
| KR | 1020180070440 | A | 6/2018 |
| KR | 10-2019-0049135 | A | 5/2019 |
| KR | 10-2019-0093027 | A | 8/2019 |
| KR | 10-2020-0031079 | A | 3/2020 |
| WO | 2016/062777 | A1 | 4/2016 |
| WO | 2019/016535 | A1 | 1/2019 |

OTHER PUBLICATIONS

Extended European Search Report dated Mar. 25, 2022 in European Application No. 21736499.1.

International Search Report dated Jun. 8, 2021, in international Application No. PCT/KR2021/002697.

Office Action issued Nov. 16, 2021 in Korean Application No. 10-2020-0057824.

European Office Action issued Feb. 19, 2024 in Application No. 21736499.1.

* cited by examiner

AEROSOL GENERATING SYSTEM

CROSS REFERENCE TO RELATED APPLICATIONS

This application is a National Stage of International Application No. PCT/KR2021/002697 filed on Mar. 4, 2021, claiming priority based on Korean Patent Application No. 10-2020-0057824 filed on May 14, 2020.

TECHNICAL FIELD

One or more embodiments of the present disclosure relate to an aerosol generating system.

BACKGROUND ART

Recently, the demand for alternative methods to overcome the disadvantages of traditional cigarettes has increased. For example, there is growing demand for an aerosol generating device which generates aerosol by heating an aerosol generating material in cigarettes, rather than by combusting cigarettes.

On the other hand, generation of an aerosol (i.e., smoke) when heating an aerosol generating article may limit the use of an aerosol generating device. Therefore, there is a need for a technology that enables both smoking with smoke and smokeless smoking such that a user may use an aerosol generating device without any restrictions due to location or environment of use.

DESCRIPTION OF EMBODIMENTS

Technical Problem

One or more embodiments of the present disclosure provide an aerosol generating system. More specifically, one or more embodiments of the present disclosure provide an aerosol generating system that enables both smoking with smoke and smokeless smoking. In addition, provided is a computer-readable recording medium having recorded thereon a computer program for executing the method.

Embodiments of the present disclosure are not limited thereto. It is to be appreciated that other embodiments will be apparent to those skilled in the art from a consideration of the specification or practice of the present disclosure described herein.

Solution to Problem

According to one aspect of the present disclosure, provided is an aerosol generating system including an aerosol generating article and an aerosol generating device, wherein the aerosol generating article includes: a tobacco medium portion including a tobacco material and a pH adjuster; and an aerosol generator including an aerosol generating material, and the aerosol generating device includes: a heater configured to receive power from a battery to heat the aerosol generating article; and a controller configured to control power supply to the heater. When the heater operates in a smokeless mode, an aerosol is not generated from the aerosol generating material, and when the heater operates in a smoke mode, an aerosol is generated from the aerosol generating material.

According to another aspect of the present disclosure, provided is a method of controlling an aerosol generating system including an aerosol generating article and an aerosol generating device, wherein the aerosol generating article includes: a tobacco medium portion including a tobacco material and a pH adjuster; and an aerosol generator including an aerosol generating material. The method includes receiving a user input to select either a smokeless mode or a smoke mode; and controlling power supply to a heater such that the heater operates in either the smokeless mode or the smoke mode based on the user input. When the heater operates in the smokeless mode, an aerosol is not generated from the aerosol generating material, and when the heater operates in the smoke mode, an aerosol is generated from the aerosol generating material.

According to another aspect of the present disclosure, a computer-readable recording medium has recorded thereon a computer program for executing the method according to another aspect of the present disclosure.

Advantageous Effects of Disclosure

The aerosol generating device according to embodiments of the present disclosure selectively determines whether to generate an aerosol by regulating a temperature range within which an aerosol generator is heated such that a user may use the aerosol generating device without any restrictions due to location or environment of use, thereby increasing user convenience.

According to embodiments of the present disclosure, as a pH adjuster is included in a tobacco medium portion, an adequate amount of nicotine may be released from the tobacco medium portion even if the aerosol generating device heats the tobacco medium portion in a smokeless mode.

BEST MODE

Figure 1:
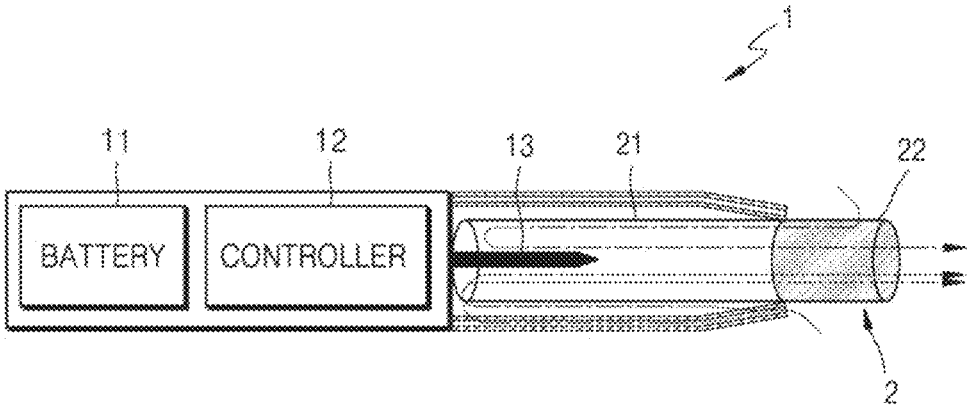
FIGS. 1 to 3 are diagrams illustrating examples in which an aerosol generating article is inserted into an aerosol generating device.

According to one aspect of the present disclosure, provided is an aerosol generating system including an aerosol generating article and an aerosol generating device, wherein the aerosol generating article includes: a tobacco medium portion including a tobacco material and a pH adjuster; and an aerosol generator including an aerosol generating material, and the aerosol generating device includes: a heater configured to receive power from a battery to heat the aerosol generating article; and a controller configured to control power supply to the heater. When the heater operates in a smokeless mode, an aerosol is not generated from the aerosol generating material, and when the heater operates in a smoke mode, an aerosol is generated from the aerosol generating material.

According to another aspect of the present disclosure, provided is a method of controlling an aerosol generating system including an aerosol generating article and an aerosol generating device, wherein the aerosol generating article includes: a tobacco medium portion including a tobacco material and a pH adjuster; and an aerosol generator including an aerosol generating material. The method includes receiving a user input to select either a smokeless mode or a smoke mode; and controlling power supply to a heater such that the heater operates in either the smokeless mode or the smoke mode based on the user input. When the heater operates in the smokeless mode, an aerosol is not generated from the aerosol generating material, and when the heater operates in the smoke mode, an aerosol is generated from the aerosol generating material.

According to another aspect of the present disclosure, a computer-readable recording medium has recorded thereon a computer program for executing the method according to another aspect of the present disclosure.

Mode of Disclosure

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In the following embodiments, terms "upstream" and "downstream" are used to indicate a relative position or direction between segments that make up an aerosol generating article. The aerosol generating article includes an upstream end portion (i.e., a portion from which air flows in) and a downstream end portion opposite the upstream end portion (i.e., a portion from which air is released). When using the aerosol generating article, a user may bite the downstream end portion of the aerosol generating article.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
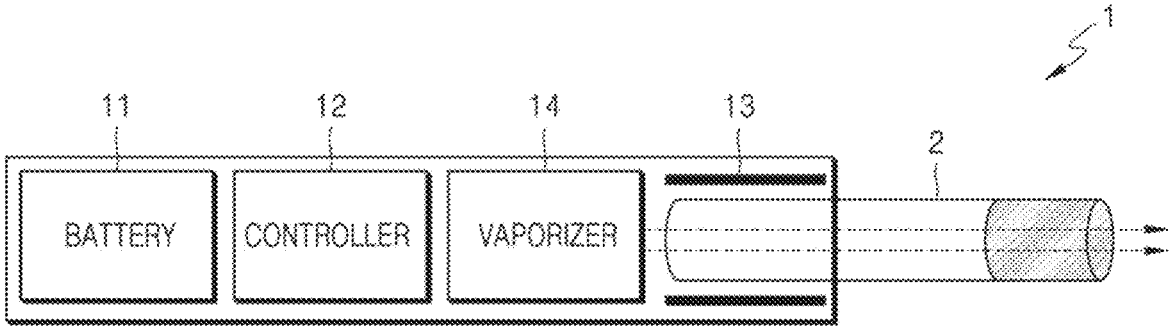
Figure 3:
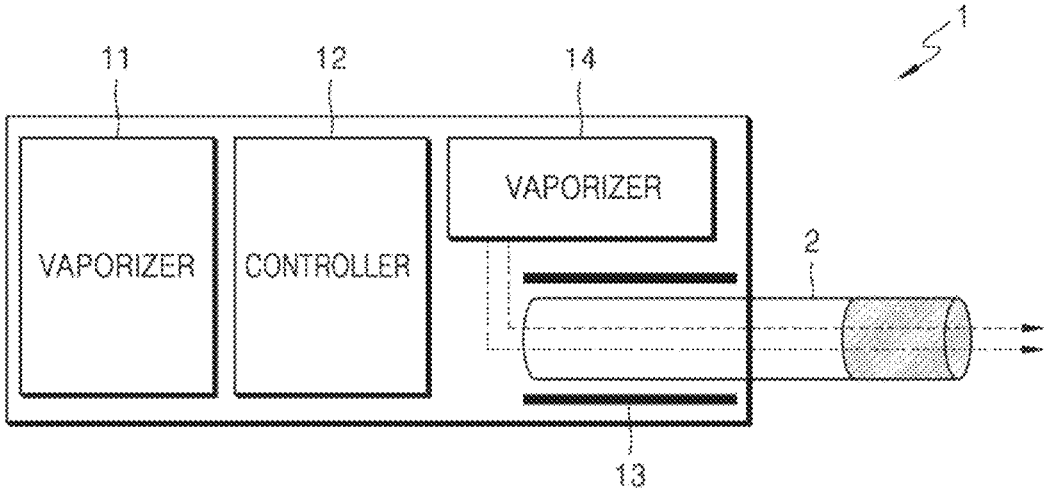

FIGS. 1 to 3 are diagrams showing examples in which an aerosol generating article is inserted into an aerosol generating device.

Referring to FIG. 1, an aerosol generating device 1 includes a battery 11, a controller 12, and a heater 13. Referring to FIGS. 2 and 3, the aerosol generating device 1 further includes a vaporizer 14. In addition, an aerosol generating article 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12 and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the aerosol generating article 2 is inserted into the aerosol generating device 1, the aerosol generating device 1 may operate the heater 13 and/or the vaporizer 14 to generate an aerosol. The aerosol generated by the heater 13 and/or the vaporizer 14 may be delivered to a user through the aerosol generating article 2.

As necessary, even when aerosol generating article 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol generating article 2 is inserted into the aerosol generating device 1, the heater 13 may be located outside the aerosol generating article 2. Thus, the heated heater 13 may increase a temperature of an aerosol generating material in the aerosol generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating an aerosol generating article 2 in an induction heating method, and the aerosol generating article 2 may include a susceptor which may be heated by the induction heater.

For example, the heater 13 may be elongate (e.g., rod-shaped, needle-shaped, or blade-shaped) or cylindrical, and may heat an interior or exterior of the aerosol generating article 2 depending on a shape of a heating element.

Also, the aerosol generating device 1 may include a plurality of heaters 13. Here, the plurality of heaters 13 may be inserted into the aerosol generating article 2 or may be arranged outside the aerosol generating article 2. Also, some of the plurality of heaters 13 may be inserted into the aerosol generating article 2 and the others may be arranged outside the aerosol generating article 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the aerosol generating article 2 to be delivered to a user. In other words, the aerosol generated via the vaporizer 14 may move along an air flow passage of the aerosol generating device 1 and the air flow passage may be configured such that the aerosol generated via the vaporizer 14 passes through the aerosol generating article 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, an aerosol generating article 2 insertion detecting sensor, etc.). Also, the aerosol generating device 1 may be formed as a structure that, even when the aerosol generating article 2 is inserted into the aerosol generating device 1, may introduce external air or discharge internal air.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The aerosol generating article 2 may be similar to a general combustive aerosol generating article 2. For example, the aerosol generating article 2 may be divided into a first portion including an aerosol generating material and a second portion including a filter, etc. Alternatively, the second portion of the aerosol generating article 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage formed in the aerosol generating device 1 may be adjusted by the user. Accordingly, the amount of smoke and a smoking impression may be adjusted by the user. As another example, the external air may flow into the aerosol generating article 2 through at least one hole formed in a surface of the aerosol generating article 2.

Figure 4:
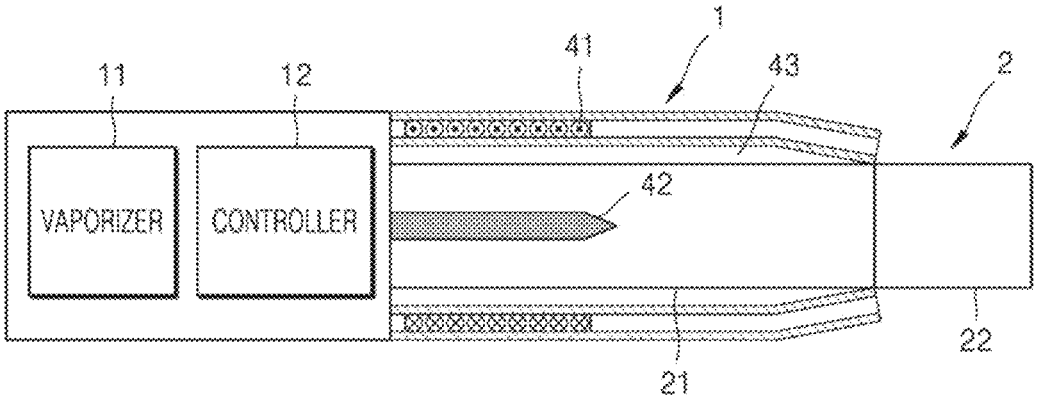
FIG. 4 is a diagram illustrating an example of an aerosol generating system using an induction heating method, according to an embodiment.

FIG. 4 is a diagram showing an example of an aerosol generating system using an induction heating method, according to an embodiment.

Referring to FIG. 4, the aerosol generating device 1 includes the battery 11, the controller 12, an induction coil 41, and a susceptor 42. In addition, at least a portion of the aerosol generating article 2 may be accommodated in a cavity 43 of the aerosol generating device 1.

Within the aerosol generating device 1 shown in FIG. 4, components related to the present embodiment are shown. Therefore, it may be understood by those of ordinary skill in the art related to the present embodiment that other general-purpose components other than the components shown in FIG. 4 may be further included in the aerosol generating device 1.

The induction coil 41 may be located around the cavity 43. FIG. 4 shows that the induction coil 41 is arranged to surround the susceptor 42 and the cavity 43. However, embodiments of the present disclosure are not limited thereto.

When the aerosol generating article 2 is accommodated in the cavity 43 of the aerosol generating device 1, the aerosol generating device 1 may supply power to the induction coil 41 such that the induction coil 41 generates an alternating magnetic field. As the alternating magnetic field generated by the induction coil 41 passes through the susceptor 42, the susceptor 42 may be heated. As an aerosol generating material within the aerosol generating article 2 is heated by the heated susceptor 42, an aerosol may be generated. The generated aerosol passes through the aerosol generating article 2 to be delivered to a user.

The battery 11 supplies power used for the aerosol generating device 1 to operate. For example, the battery 11 may supply power for the induction coil 41 to generate an alternating magnetic field, and may supply power required for the controller 12 to operate. The battery 11 may also supply power required for a display, sensor, motor, and the like installed within the aerosol generating device 1 to operate.

The controller 12 controls the overall operation of the aerosol generating device 1. More specifically, the controller 12 also controls operation of other components included within the aerosol generating device 1 apart from the battery 11 and the induction coil 41. In addition, the controller 12 may check states of each of the components of the aerosol generating device 1 to determine whether or not the aerosol generating device 1 is able to operate.

The induction coil 41 may be an electrically conductive coil that generates an alternating magnetic field by power supplied from the battery 11. The induction coil 41 may be arranged to surround at least a portion of the cavity 43. The alternating magnetic field generated by the induction coil 41 may be applied to the susceptor 42 arranged at an inner end portion of the cavity 43.

The susceptor 42 may be heated as the alternating magnetic field generated by the induction coil 41 penetrates, and may include metal or carbon. For example, the susceptor 42 may include at least one of ferrite, ferromagnetic alloy, stainless steel, and aluminum.

In addition, the susceptor 42 may include at least one of ceramic, such as graphite, molybdenum, silicon carbide, niobium, nickel alloy, metal film, zirconia, etc, a transition metal, such as nickel (Ni) or cobalt (Co), etc, and a metalloid, such as boron (B) or phosphorus (P). However, the susceptor 42 is not limited to the above-described examples, and may include anything as long as it is able to be heated to a desired temperature as an alternating magnetic field is applied. Here, the desired temperature may be preset within the aerosol generating device 1 or may be set as a temperature desired by the user.

When the aerosol generating article 2 is accommodated in the cavity 43 of the aerosol generating device 1, the susceptor 42 may be located within the aerosol generating article 2. Accordingly, the heated susceptor 42 may raise a temperature of an aerosol generating material within the aerosol generating article 2.

FIG. 4 shows that the susceptor 42 is inserted into the aerosol generating article 2. However, embodiments of the present disclosure are not limited thereto. For example, the susceptor 42 may include a tubular heating element, a plate-shaped heating element, a needle-shaped heating element, or a rod-shaped heating element, and depending on a shape of the heating element, an interior or exterior of the aerosol generating article 2 may be heated.

In addition, a plurality of susceptors 42 may be arranged within the aerosol generating device 1. In that case, the plurality of susceptors 42 may be arranged to be inserted into the aerosol generating article 2, or may be arranged outside the aerosol generating article 2. Alternatively, a portion of the plurality of susceptors 42 may be arranged to be inserted into the aerosol generating article 2, and the reste may be arranged outside the aerosol generating article 2. A shape of the susceptor 42 is not limited to the shape illustrated in FIG. 4, and the susceptor 42 may be manufactured in various shapes.

Figure 5:
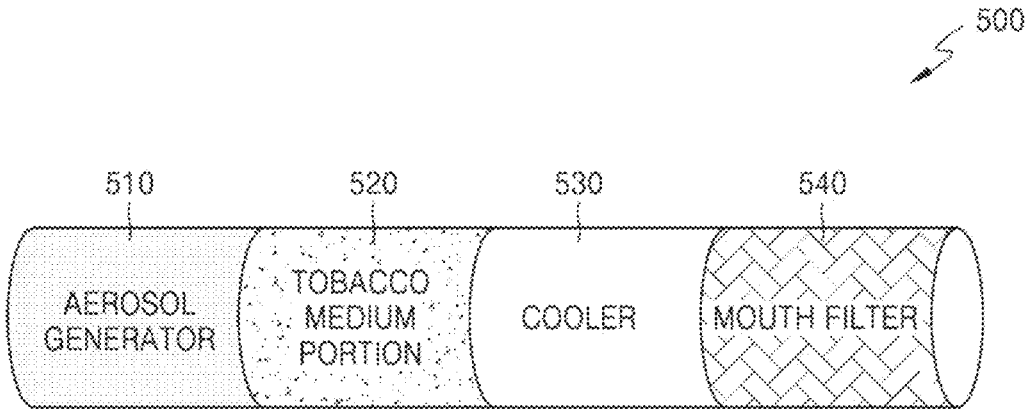
FIG. 5 is a diagram illustrating an example of an aerosol generating article, according to an embodiment.

FIG. 5 is a diagram illustrating an example of an aerosol generating article, according to an embodiment.

Referring to FIG. 5, an aerosol generating article 500 includes an aerosol generator 510, a tobacco medium portion 520, and a filter portion. The filter portion includes a cooler 530 and a mouth filter 540. If necessary, the filter portion may further include a segment configured to perform other functions. According to an embodiment, the tobacco medium portion 520 may be connected to a downstream end portion of the aerosol generator 510, and the filter portion may be connected to a downstream end portion of the tobacco medium portion 520.

The aerosol generator 410 includes an aerosol generating material. The aerosol generator 510 may include at least one of glycerin, propylene glycol, ethylene glycol, dipropylene glycol, diethylene glycol, triethylene glycol, tetraethylene glycol, sorbitol, and oleyl alcohol. However, embodiments of the present disclosure are not limited thereto. As the aerosol generator 510 is heated, an aerosol may be generated.

For example, the aerosol generator 510 may be made of paper, and the aerosol generating material may be impregnated with paper. The aerosol generating material may include 4 mg to 8 mg per mm in a transverse direction of the aerosol generator 510.

The tobacco medium portion 520 includes a tobacco material containing nicotine. The tobacco medium portion 520 may include a tobacco material such as tobacco leaves, reconstituted tobacco, and tobacco granules. The tobacco medium portion 520 may be made of a sheet, a strand, or cut fillers obtained by finely cutting a tobacco sheet.

The cooler 530 cools the aerosol generated by heating at least one of the aerosol generator 510 and the tobacco medium portion 520. Accordingly, a user may inhale the aerosol cooled to an appropriate temperature.

According to an embodiment, the cooler 530 may be a hollow cellulose acetate filter. According to another embodiment, the cooler 530 may be a filter made of a polymer fiber. The cooler 530 may be formed by weaving a polymer fiber, or may be formed of a crimped polymer sheet. For example, the polymer may be made from a material selected from the group consisting of polyethylene (PE), polypropylene (PP), polyvinyl chloride (PVC), polyethylene terephthalate (PET), polylactic acid (PLA), cellulose acetate (CA), and aluminum foil.

According to another embodiment, the cooler 530 may be a filter made of a cylindrical hollow paper tube or cardboard tube with an open end portion. The cooler 530 may be made of a paper tube having little difference between an outer diameter and an inner diameter. In addition, the cooler 530 may include perforations. For example, the cooler 530 may be made of triple-layered paper (outer paper, intermediate paper, and inlay), and a PLA coated layer may be applied onto an inner side of the inlay paper.

The mouth filter 540 may be a cellulose acetate filter. The mouth filter 540 may have a cylindrical shape, or a tubular shape including a hollow therein. Alternatively, the mouth filter 540 may have a recessed shape.

In addition, the mouth filter 540 may include at least one capsule. The capsule may serve to generate a flavor or an aerosol. For example, the capsule may have a structure in which a liquid containing fragrance is wrapped with a film. The capsule may be spherical or cylindrical. However, embodiments of the present disclosure are not limited thereto.

Although not shown in FIG. 5, the aerosol generating article 500 may be packaged by at least one wrapper. At least one hole through which air flows in from the outside or a gas leaks out may be formed within the wrapper. As an example, the aerosol generating article 500 may be packaged by one wrapper. As another example, the aerosol generating article 500 may be packaged in multiple layers by two or more wrappers.

Figure 6A:
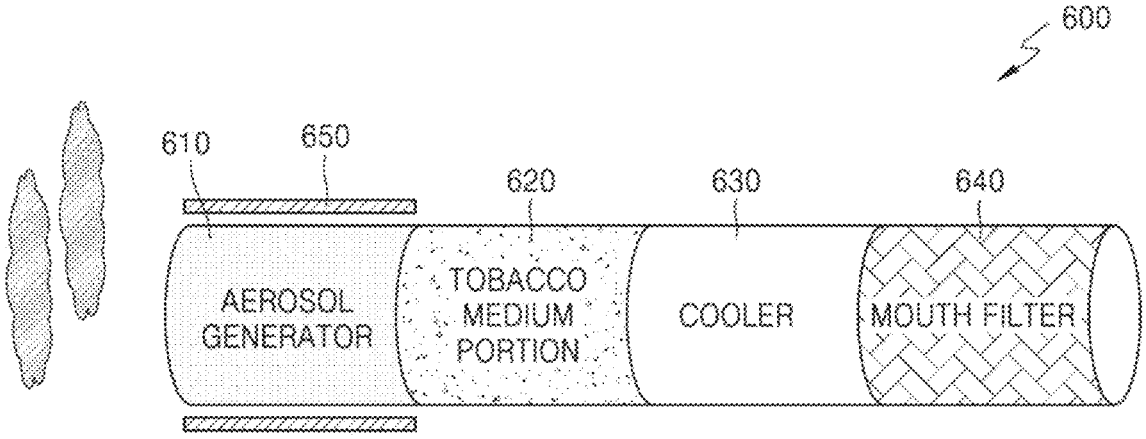
FIGS. 6A and 6B are diagrams illustrating examples of an aerosol generating system operating in a smoke mode and a smokeless mode, according to an embodiment.
Figure 6B:
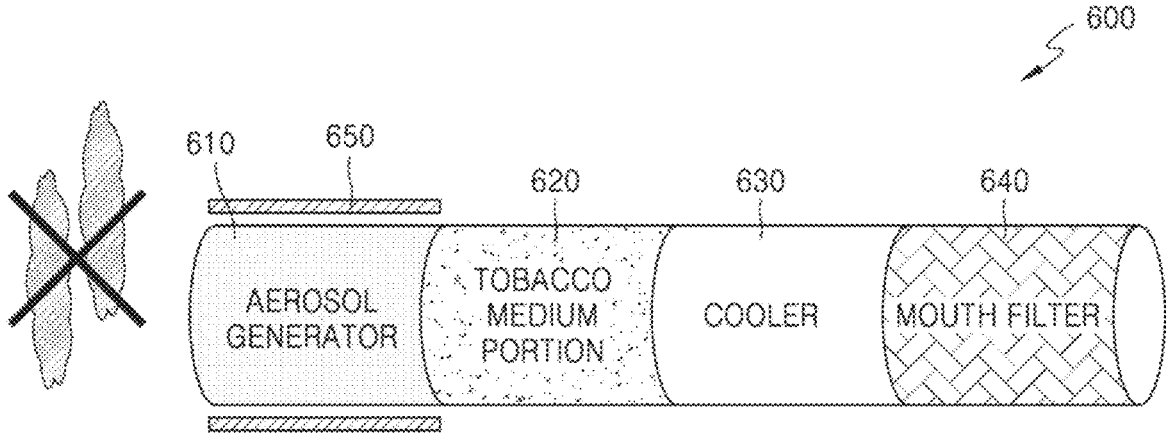

FIGS. 6A and 6B are diagrams illustrating examples of an aerosol generating system operating in a smoke mode and a smokeless mode, according to an embodiment.

Referring to FIGS. 6A and 6B, an aerosol generating article 600 includes an aerosol generator 610, a tobacco medium portion 620, and a filter portion. The filter portion may include a cooler 630 and a mouth filter 640.

The aerosol generator 610 includes an aerosol generating material. The aerosol generator 610 may include at least one of glycerin, propylene glycol, ethylene glycol, dipropylene glycol, diethylene glycol, triethylene glycol, tetraethylene glycol, sorbitol, and oleyl alcohol. However, embodiments of the present disclosure are not limited thereto. As the aerosol generator 610 is heated, an aerosol may be generated.

The tobacco medium portion 620 includes a tobacco material containing nicotine.

The tobacco medium portion 620 may further include a pH adjuster. The pH adjuster is basic and may include, for example, at least one of potassium carbonate ($K_2CO_3$), sodium hydrogen carbonate ($NaHCO_3$), and calcium oxide (CaO). However, materials included in the pH adjuster are not limited to the above-described examples, and a material that generates less negative odor during smoking may be used. A pH value of the pH adjuster may be about 7.5 to about 8.5, but is not limited thereto.

The basic pH adjuster increases pH of the tobacco material included in the tobacco medium portion 620. Compared with a tobacco medium portion not containing the basic pH adjuster, the tobacco medium portion 620 containing the basic pH adjuster increases an amount of nicotine released upon heating.

That is, when the basic pH adjuster is included in the tobacco medium portion 620, an adequate nicotine yield may be achieved even if the tobacco medium portion 620 is heated at a low temperature. For example, when the tobacco material contained in a first tobacco medium portion and a second tobacco medium portion is the same and the basic pH adjuster is further included only in the first tobacco medium portion, a nicotine yield to be obtained when the second tobacco medium portion is heated to 250° C. and a nicotine yield to be obtained when the first tobacco medium is heated to 150° C. may be the same.

In order for an aerosol to be generated from the aerosol generator 610, the aerosol generator 610 needs to be heated at a certain temperature or higher. The certain temperature at which an aerosol is generated from the aerosol generator 610 may vary depending on a material included in the aerosol generator 610. More specifically, the larger an average molecular weight of the material included in the aerosol generator 610, the higher the certain temperature at which an aerosol is generated from the aerosol generator 610. The aerosol generator 610 may contain 20% or less of an aerosol generating material. It is desirable that the aerosol generator 610 contain 15% or less of the aerosol generating material.

A heater 650 may operate in either a smoke mode or a smokeless mode.

FIG. 6A is a diagram illustrating an example in which a heater operates in the smoke mode, according to an embodiment. FIG. 6B is a diagram illustrating an example in which a heater operates in the smokeless mode, according to an embodiment.

When the heater 650 operates in the smoke mode, an aerosol is generated from the aerosol generator 610, and when the heater 650 operates in the smokeless mode, an aerosol is not generated from the aerosol generator 610.

In the smoke mode and the smokeless mode, temperature ranges within which the heater 650 heats the aerosol generating article 600 are different from each other. In the smoke mode, the heater 650 heats the aerosol generating article 600 in a first temperature range, and in the smokeless mode, the heater 650 heats the aerosol generating article 600 in a second temperature range. The first temperature range is higher than the second temperature range.

The first temperature range and the second temperature range may be determined by a molecular weight of the aerosol generating material within the aerosol generator 610 and a pH value of the pH adjuster within the tobacco medium portion 620. For example, the larger a molecular weight (or average molecular weight) of the aerosol generating material within the aerosol generator 610, the higher the first temperature range. In addition, the higher the pH value of the pH adjuster within the tobacco medium portion 620, the lower the second temperature range. For example, the first temperature range may be 270° C. to 320° C., and the second temperature range may be 140° C. to 170° C.

The aerosol generating article 600 according to embodiments of the present disclosure includes the aerosol generator 610 and the tobacco medium portion 620. The aerosol generator 610 includes the aerosol generating material, and the tobacco medium portion 620 includes the pH adjuster.

An aerosol generating device may selectively determine whether to generate an aerosol (i.e., smoke) by regulating a temperature range within which the aerosol generating article 600 is heated. That is, when the aerosol generating device operates the heater 650 in the smoke mode, an aerosol is generated from the aerosol generator 610, and when the aerosol generating device operates the heater 650 in the smokeless mode, an aerosol is not generated from the aerosol generator 610.

Generation of an aerosol (i.e., smoke) when using the aerosol generating device may limit the use of the aerosol generating device. The aerosol generating device according to embodiments of the present disclosure may selectively determine whether to generate an aerosol by regulating a temperature range within which the aerosol generator 610 is heated, such that a user may use the aerosol generating device without any restrictions due to location or environment of use, thereby increasing user convenience.

In addition, the temperature range within which the heater 650 heats the tobacco medium portion 620 in the smoke mode is higher than the temperature range within which the heater 650 heats the tobacco medium portion 620 in the smokeless mode. As the pH adjuster is included within the tobacco medium portion 620, even if the heater 650 heats the tobacco medium portion 620 in the smokeless mode, an adequate amount of nicotine may be released from the tobacco medium portion 620. In other words, even if the heater 650 operates in either the smoke mode or the smokeless mode, an adequate amount of nicotine may be released from the tobacco medium portion 620.

Figure 7:
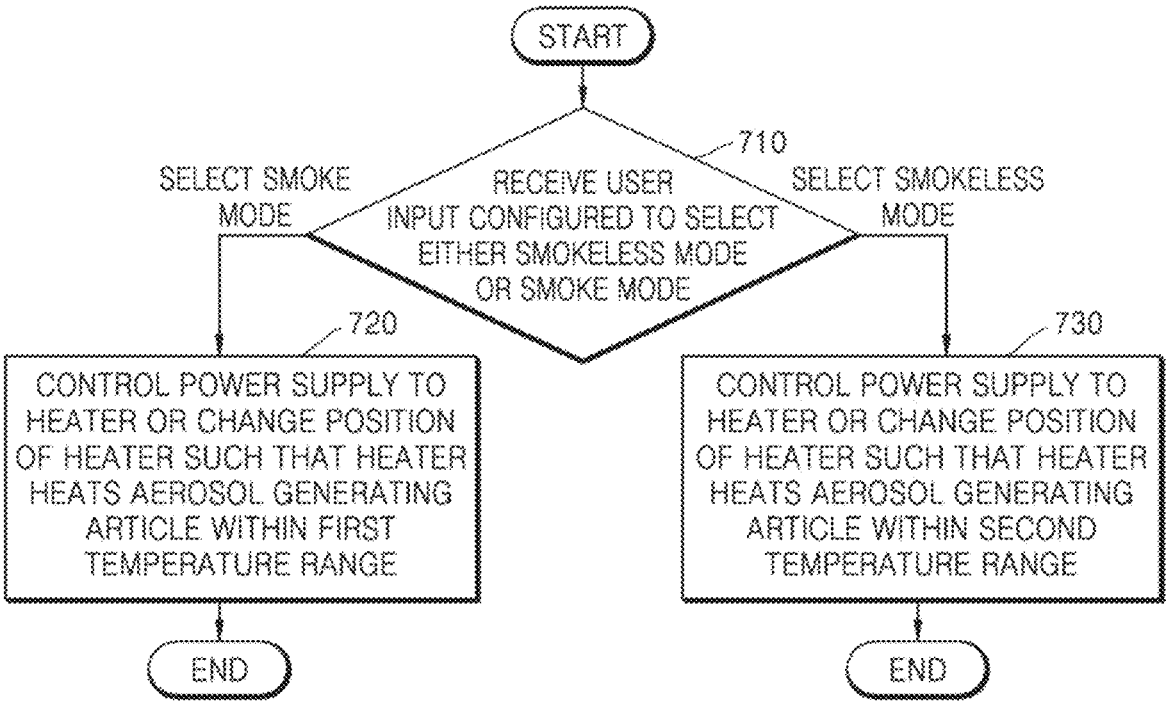
FIG. 7 is a flowchart of an operation process of an aerosol generating device operating in a smoke mode or a smokeless mode, according to an embodiment.

FIG. 7 is a flowchart of an operation process of an aerosol generating device operating in a smoke mode or a smokeless mode, according to an embodiment.

An aerosol generating system may include an aerosol generating article and an aerosol generating device.

The aerosol generating article may include a plurality of segments. The aerosol generating article may include a tobacco medium portion including a tobacco material and a pH adjuster, and an aerosol generator including an aerosol generating material. The aerosol generating article may further include a filter portion.

For example, the tobacco medium portion may include a basic pH adjuster having a pH of about 7.5 to about 8.5. The aerosol generator may include 15% or less of the aerosol generating material.

Referring to FIG. 7, the aerosol generating device may receive a user input configured to select either a smokeless mode or smoke mode, in operation 710. According to an embodiment, the aerosol generating device may include a user interface and receive the user input through the user interface. For example, the user interface may include a button or a touch screen.

In operation 720, the aerosol generating device may control power supplied to a heater or change a position of the heater such that the heater heats the aerosol generating article within a first temperature range in response to a user selecting the smoke mode.

In operation 730, the aerosol generating device may control power supply to the heater or change the position of the heater such that the heater heats the aerosol generating article within a second temperature range in response to the user selecting the smokeless mode.

When the user selects the smoke mode, as the heater heats the aerosol generating article within the first temperature range, an aerosol is generated from the aerosol generator. In contrast, when the user selects the smokeless mode, as the heater heats the aerosol generating article within the second temperature range, an aerosol is not generated from the aerosol generator. The first temperature range is higher than the second temperature range. For example, the first temperature range may be 270° C. to 320° C., and the second temperature range may be 140° C. to 170° C.

The first temperature range and the second temperature range may be determined by a molecular weight of the aerosol generating material in the aerosol generator and a pH value of the pH adjuster in the tobacco medium portion. For example, the larger the molecular weight (or average molecular weight) of the aerosol generating material in the aerosol generator, the higher the first temperature range. In addition, the higher the pH value of the pH adjuster within the tobacco medium portion, the lower the second temperature range.

According to an embodiment, the aerosol generating device may operate the heater in the smoke mode or the smokeless mode by controlling power supply to the heater while the position of the heater is fixed.

For example, the aerosol generating device may regulate a duty ratio of power supply to the heater by using a proportional integral derivation (PID) control method. The aerosol generating device may also regulate the duty ratio of power supply to the heater by using a pulse width modulation (PWM) control method. However, embodiments of the present disclosure are not limited thereto.

According to another embodiment, the aerosol generating device may operate the heater in the smoke mode or the smokeless mode by changing the position of the heater while maintaining the same power supply to the heater.

The aerosol generating device may locate the heater at a first position in response to the user selecting the smoke mode. The aerosol generating device may also locate the heater at a second position in response to the user selecting the smokeless mode.

For example, when the heater is of an external heating type, the first position of the heater may be separated away from a longitudinal central axis of the aerosol generating article by a first distance, and the second position of the heater may be separated away from the longitudinal central axis of the aerosol generating article by a second distance. The first distance has a lower value than the second distance.

That is, while maintaining the same power supply to the heater, when the aerosol generating device locates the heater at the first position such that the heater and the aerosol generating article are located close to each other in the smoke mode and when the aerosol generating device locates the heater at the second position such that the heater and the aerosol generating article are located away from each other in the smokeless mode, the aerosol generating article may be heated by the heater within a higher temperature range in the smoke mode than in the smokeless mode.

According to another embodiment, the aerosol generating device may operate the heater in the smoke mode or the smokeless mode by controlling the power supply to the heater and changing the position of the heater.

In order to change the position of the heater, the aerosol generating device may further include a moving device. For example, when the heater is of an external heating type, the moving device may be a flexible tubular substrate. When the heater is located on the flexible tubular substrate and the aerosol generating device regulates a diameter of the flexible tubular substrate, a distance between the heater and the aerosol generating article may be regulated. That is, when the diameter of the tubular substrate increases, the distance between the heater and the aerosol generating article may increase, and when the diameter of the tubular substrate decreases, the distance between the heater and the aerosol generating article may decrease.

Figure 8:
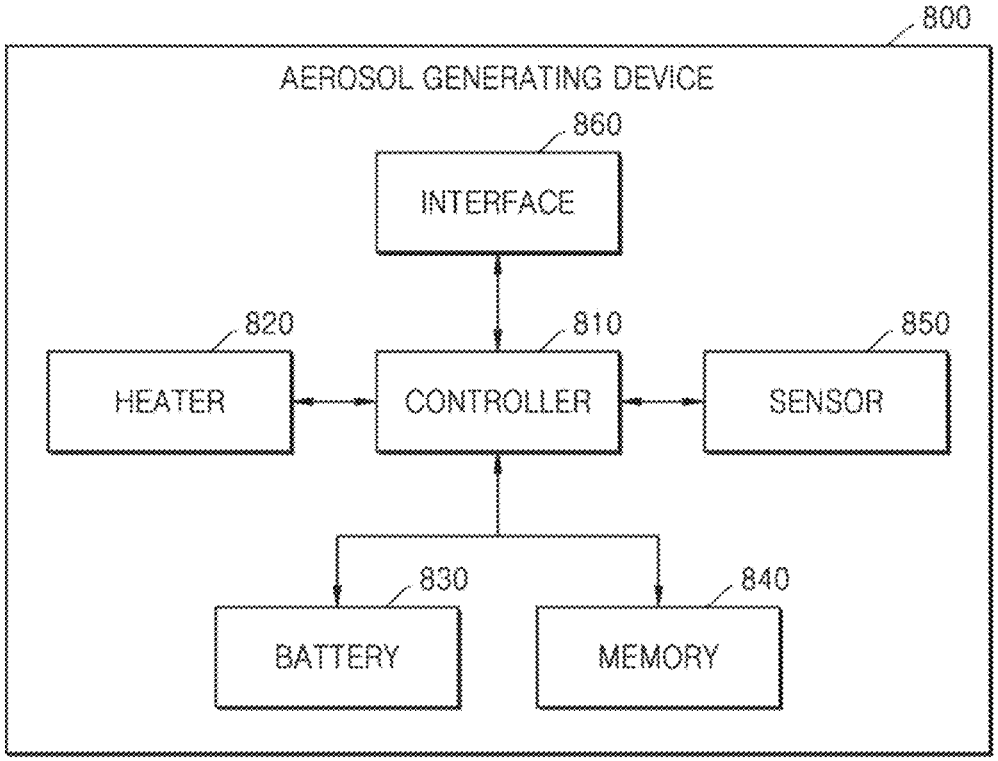
FIG. 8 is a block diagram illustrating a hardware configuration of an aerosol generating device, according to an embodiment.

FIG. 8 is a block diagram illustrating a hardware configuration of an aerosol generating device, according to an embodiment.

Referring to FIG. 8, an aerosol generating device 800 may include a controller 810, a heater 820, a battery 830, a memory 840, a sensor 850, and an interface 860. However, an internal structure of the aerosol generating device 800 is not limited to that shown in FIG. 8. It may be understood by those of ordinary skill in the art related to the present embodiment that depending on a design of the aerosol generating device 800, some of the hardware configuration shown in FIG. 8 may be omitted or a new configuration may be added thereto.

The heater 820 is electrically heated by power supply from the battery 830 under the control of the controller 810. The heater 820 is located in a reception passage of the aerosol generating device 800 configured to accommodate an aerosol generating article. When the aerosol generating article is inserted into the aerosol generating device 800 from the outside through an insertion hole of the aerosol generating device 800 and moves along the reception passage, one end portion of the aerosol generating article may be inserted into the heater 820. Therefore, the heated heater 820 may increase a temperature of an aerosol generating material in the aerosol generating article. The heater 820 may have any shape as long as it may be inserted into the aerosol generating article.

The heater 820 may include a heat source and a heat transfer object. For example, the heat source of the heater 820 may be manufactured in a film shape having an electrical resistive pattern, and the film-shaped heater 820 may be arranged to surround at least a portion of an outer surface of the heat transfer object (e.g., a heat transfer tube).

The heat transfer tube may include a metal material capable of transferring heat, such as aluminum or stainless steel, an alloy material, carbon, ceramic material, and the like. When power is supplied to the electrical resistive pattern of the heater 820, heat may be generated, and the generated heat may heat the aerosol generating material through the heat transfer tube.

The aerosol generating device 800 may be provided with a separate temperature detection sensor. Alternatively, instead of providing a separate temperature detection sensor to the aerosol generating device 800, the heater 820 may serve as a temperature detection sensor. Alternatively, while the heater 820 serves as a temperature detection sensor, the aerosol generating device 800 may be further provided with a separate temperature detection sensor. The temperature detection sensor may be arranged on the heater 820 in the form of a conductive track or an element.

For example, when a voltage applied to the temperature detection sensor and a current flowing through the temperature detection sensor are measured, resistance R may be determined. In that case, the temperature detection sensor may measure temperature T according to Equation 1 below.

$$R = R_0[1+\alpha(T-T_0)] \quad \text{[Equation 1]}$$

In Equation 1, R refers to a current resistance value of the temperature detection sensor, R0 refers to a resistance value at temperature T0 (e.g., 0° C.), and a refers to a resistance temperature coefficient of the temperature detection sensor. Since a conductive material (e.g., metal) has a unique resistance temperature coefficient, a may be predetermined according to the conductive material constituting the temperature detection sensor. Therefore, when the resistance R of the temperature detection sensor is determined, the temperature T of the temperature detection sensor may be calculated by Equation 1.

The controller 810 is hardware configured to control the overall operation of the aerosol generating device 800. The controller 810 is an integrated circuit implemented as a processing unit such as a microprocessor, a microcontroller, and the like.

The controller 810 analyzes a result sensed by the sensor 850 and controls subsequent processes to be performed. The controller 810 may start or suspend power supply from the battery 830 to the heater 820 according to the sensed result. In addition, the controller 810 may control an amount of power supply to the heater 820 and a time at which the power is supplied such that the heater 820 is heated to a certain temperature or maintains an appropriate temperature. Furthermore, the controller 810 may process various input information and output information of the interface 860.

According to an embodiment, the controller 810 may receive a user input configured to select either a smokeless mode or a smoke mode through the interface 860.

The controller 810 may control power supply to the heater 820 or change a position of the heater such that the heater 820 heats the aerosol generating article within a first temperature range, in response to a user selecting the smoke mode. The controller 810 may also control power supply to the heater 820 or change the position of the heater such that the heater 820 heats the aerosol generating article within a second temperature range, in response to the user selecting the smokeless mode.

The controller 810 may count the number of smoking by the user using the aerosol generating device 800, and control related functions of the aerosol generating device 800 to restrict the user's smoking according to the counted result.

The memory 840 is hardware configured to store various types of data processed within the aerosol generating device 800 and may store data processed and data to be processed by the controller 810. The memory 840 may be implemented with a variety of types, such as random access memory (RAM) such as dynamic random access memory (DRAM), static random access memory (SRAM), and the like, read-only memory (ROM), electrically erasable programmable read-only memory (EEPROM), and the like.

The memory 840 may store data on the user's smoking pattern, such as smoking time, smoking frequency, and the like. The memory 840 may also store data related to a reference temperature change value when the aerosol generating article is accommodated in the reception passage.

The memory 840 may also store a plurality of temperature correction algorithms.

The battery 830 supplies power used for the aerosol generating device 800 to operate. That is, the battery 830 may supply power for the heater 820 to be heated. The battery 830 may also supply power required for the operation of other hardware, the controller 810, the sensor 850, and the interface 860 included within the aerosol generating device 800. The battery 830 may be a lithium iron phosphate (LiFePO4) battery, but is not limited thereto, and may be manufactured as a lithium cobalt oxide (LiCoO2) battery, a lithium titanate battery, or the like. The battery 830 may be a rechargeable battery or a disposable battery.

The sensor 850 may include various types of sensors, such as a puff detection sensor (temperature detection sensor, flow detection sensor, position detection sensor, etc.), an insertion detection sensor of the aerosol generating article, a temperature detection sensor of the heater 820, a reuse detection sensor of the aerosol generating article, and the like. The result sensed by the sensor 850 may be transmitted to the controller 810, and the controller 810 may control the aerosol generating device 800 to perform various functions, such as restriction of the heater temperature, restriction of smoking, determining of whether to insert the aerosol generating article, display of notification, determining whether to reuse the aerosol generating article, and the like according to the sensed result.

The interface 860 may include various interfacing means such as a display or lamp for outputting visual information, a motor for outputting tactile information, a speaker for outputting sound information, an input/output (I/O) interfacing means (e.g., button or touch screen) for receiving information input from the user or outputting information to the user, terminals for data communication or for receiving charging power, a communication interfacing module for performing wireless communication with an external device (e.g., wireless fidelity (Wi-Fi), Wi-Fi direct, blue-tooth, near-field communication (NFC)), and the like. However, the aerosol generating device 800 may be implemented by selectively choosing only some of the various interfacing means described above.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating system comprising an aerosol generating article and an aerosol generating device, the aerosol generating article comprising:

a tobacco medium portion comprising a tobacco material and a pH adjuster; and an aerosol generator comprising an aerosol generating material, the aerosol generating device comprising:

a heater configured to receive power from a battery to heat the aerosol generating article; and a controller configured to:

control power supplied to the heater;

regulate the heater within a first temperature range based on the heater operating in a smokeless mode; and regulate the heater within a second temperature range based on the heater operating in a smoke mode, wherein when the heater operates in the smokeless mode, an aerosol is not generated from the aerosol generating material, and when the heater operates in the smoke mode, an aerosol is generated from the aerosol generating material.

2. The aerosol generating system of claim 1, wherein the tobacco medium portion comprises the pH adjuster having a pH of about 7.5 to about 8.5.

3. The aerosol generating system of claim 1, wherein the aerosol generator comprises 20% or less of the aerosol generating material.

4. The aerosol generating system of claim 1, wherein the aerosol generating device further comprises a user interface configured to receive a user input to select either the smoke mode or the smokeless mode, and the controller is further configured to control the power supplied to the heater such that the heater operates in either the smokeless mode or the smoke mode based on the user input.

5. The aerosol generating system of claim 1, wherein, in the smoke mode, the heater heats the aerosol generating article within the first temperature range and in the smokeless mode, the heater heats the aerosol generating article within the second temperature range, wherein the first temperature range is higher than the second temperature range.

6. The aerosol generating system of claim 5, wherein the first temperature range and the second temperature range are determined by a pH value of the pH adjuster and a molecular weight of the aerosol generating material.

7. The aerosol generating system of claim 1, wherein, in the smoke mode, the heater is at a first position and heats the aerosol generating article within the first temperature range, and in the smokeless mode, the heater is at a second position and heats the aerosol generating article within the second temperature range, wherein the first temperature range is higher than the second temperature range, and the heater is movable between the first position and the second position.

8. The aerosol generating system of claim 1, wherein the tobacco medium portion is connected to a downstream end portion of the aerosol generator, and a filter portion is connected to a downstream end portion of the tobacco medium portion.

9. A method of controlling an aerosol generating system comprising an aerosol generating article and an aerosol generating device, the aerosol generating article comprising:

a tobacco medium portion comprising a tobacco material and a pH adjuster; and an aerosol generator comprising an aerosol generating material, the method comprising:

receiving a user input to select either a smokeless mode or a smoke mode; and controlling power supplied to a heater such that the heater operates in either the smokeless mode or the smoke mode based on the user input, wherein the controlling of the power supplied to the heater comprises regulating the heater within a first temperature range based on the heater operating in the smokeless mode and regulating the heater within a second temperature range based on the heater operating in the smoke mode, and wherein when the heater operates in the smokeless mode, an aerosol is not generated from the aerosol generating material, and when the heater operates in the smoke mode, an aerosol is generated from the aerosol generating material.

10. The method of claim 9, wherein the tobacco medium portion contains the pH adjuster having a pH of about 7.5 to about 8.5.

11. The method of claim 9, wherein the aerosol generator comprises 20% or less of the aerosol generating material.

12. The method of claim 9, wherein the controlling comprises controlling the power supplied to the heater such that the heater heats the aerosol generating article within the first temperature range in response to a user selecting the smoke mode, and controlling the power supplied to the heater such that the heater heats the aerosol generating article within the second temperature range in response to the user selecting the smokeless mode, wherein the first temperature range is higher than the second temperature range.

13. The method of claim 12, wherein the first temperature range and the second temperature range are determined by a pH value of the pH adjuster and a molecular weight of the aerosol generating material.

14. The method of claim 12, wherein the controlling further comprises locating the heater at a first position and controlling the power supplied to the heater such that the heater heats the aerosol generating article within the first temperature range in response to the user selecting the smoke mode, and locating the heater at a second position and controlling the power supplied to the heater such that the heater heats the aerosol generating article within the second temperature range in response to the user selecting the smokeless mode, wherein the first temperature range is higher than the second temperature range, and the heater is movable between the first position and the second position.

15. A computer-readable recording medium having recorded thereon a computer program for executing the method of claim 9.

* * * * *